US006802599B1

(12) United States Patent
Pannu

(10) Patent No.: US 6,802,599 B1
(45) Date of Patent: Oct. 12, 2004

(54) DROPLET GENERATOR FOR A CONTINUOUS STREAM INK JET PRINT HEAD

(75) Inventor: Sukbir Pannu, Cambridge (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 10/088,827

(22) PCT Filed: Sep. 22, 2000

(86) PCT No.: PCT/GB00/03644

§ 371 (c)(1),
(2), (4) Date: Jul. 3, 2002

(87) PCT Pub. No.: WO01/21406

PCT Pub. Date: Mar. 29, 2001

(30) Foreign Application Priority Data

Sep. 23, 1999 (GB) ..... 9922421

(51) Int. Cl.[7] ..... B41J 2/02
(52) U.S. Cl. ..... 347/73
(58) Field of Search ..... 347/73, 47, 75, 347/76, 74

(56) References Cited

U.S. PATENT DOCUMENTS 3,882,508 A 5/1975 Stoneburner
4,827,287 A 5/1989 Braun et al.
5,502,473 A 3/1996 East et al.

FOREIGN PATENT DOCUMENTS

GB 2 003 429 A 3/1979

OTHER PUBLICATIONS

Naoki Morita: "Characteristics of a Traveling–Wave Drop Generator for a Multinozzle Continuous Ink Jet Printer" Electronics & Communications in Japan, Part II—Electronics, US, Scripta Technica. New York, vol. 73, No. 10, Oct. 1, 1990.

*Primary Examiner*—K. Feggins
(74) *Attorney, Agent, or Firm*—Kirschstein, et al.

(57) ABSTRACT

A droplet generator for a continuous stream ink jet print head includes an elongate cavity for containing the ink and nozzle orifices in a wall of the cavity for passing ink from the cavity to form jets. The nozzle orifices extend along the length of the cavity. An actuator is disposed on the opposite side of the cavity to the wall for vibrating the ink in the cavity such that each jet breaks up into ink droplets. In operation of the generator, a standing wave is present in the ink in the cavity. The cross-sectional area of the cavity varies along its length in a manner so as to tailor the form of the standing wave in the cavity such that each jet breaks up into the ink droplets at a respective predetermined distance from the wall of the cavity.

9 Claims, 5 Drawing Sheets

DROPLET GENERATOR FOR A CONTINUOUS STREAM INK JET PRINT HEAD

BACKGROUND OF THE INVENTION

This invention relates to a droplet generator for a continuous stream ink jet print head.

More particularly the invention relates to such a generator comprising: an elongate cavity for containing the ink; nozzle orifices in a wall of said cavity for passing ink from the cavity to form jets, said nozzle orifices extending along the length of said cavity; and actuator means disposed on the opposite side of said cavity to said wall for vibrating the ink in said cavity such that each said jet breaks up into ink droplets, in operation of said generator a standing wave being present in the ink in said cavity.

An example of a generator as described in the preceding paragraph is disclosed in U.S. Pat. No. 5,502,473. The generator of U.S. Pat. No. 5,502,473 is designed to operate at, or very close to, a frequency at which its ink cavity is resonant in the vertical direction, i.e. from the actuator means to the nozzle orifices. This requires a very high accuracy in the physical dimensions of the structural components of the generator. It also permits very little stray in operating parameters of the generator such as ink composition and temperature.

U.S. Pat. No. 4,827,287 discloses a droplet generator for a continuous stream ink jet print head. In this generator, in order to achieve the required jet break up, a travelling wave is caused to travel along an elongate nozzle orifice containing plate by means of the direct physical vibration of one end of the plate. The area of the plate free to vibrate is narrowed in the direction of wave propagation to compensate for attenuative losses. U.S. Pat. No. 4,827,287 uses what is called a waveguided construction.

BRIEF SUMMARY OF THE INVENTION

According to the present invention there is provided a droplet generator for a continuous stream ink jet print head comprising: an elongate cavity for containing the ink; nozzle orifices in a wall of said cavity for passing ink from the cavity to form jets, said nozzle orifices extending along the length of said cavity; and actuator means disposed on the opposite side of said cavity to said wall for vibrating the ink in said cavity such that each said jet breaks up into ink droplets, in operation of said generator a standing wave being present in the ink in said cavity, characterised in that the cross-sectional area of said cavity varies along its length in a manner so as to tailor the form of said standing wave in the cavity such that each said jet breaks up into ink droplets at a respective predetermined distance from said wall of the cavity.

Preferably, the tailoring of the form of said standing wave is such that each said jet breaks up into ink droplets at substantially the same predetermined distance from said wall of the cavity.

Preferably, in the case of the preceding paragraph, the cross-sectional area of the cavity varies cyclically along its length between minimum and maximum values, said cross-sectional area having a minimum value whereat said standing wave has a region of low acoustic pressure at the nozzle orifices, said cross-sectional area having a maximum value whereat said standing wave has a region of high acoustic pressure at the nozzle orifices. The cyclical variation is for example sinusoidal.

In the case of each of the preceding two paragraphs, the cavity suitably has a generally triangular or a generally rectangular cross-section.

The invention also provides a method of operating a generator according to each of the preceding three paragraphs wherein the parameters of the operation of the generator are permitted to stray such that said cavity operates over a range extending substantially all the way between two successive resonances in the length of the cavity. Typically the parameters of the operation permitted to stray are ink composition and temperature.

The invention further provides a method of operating a generator according to each of the aforementioned three paragraphs wherein the cavity operates at substantially midway between two successive resonances in the length of the cavity.

A droplet generator in accordance with the present invention will now be described, by way of example, with reference to the accompanying drawings, in which:

DETAIL DESCRIPTION OF THE INVENTION

Figure 2:
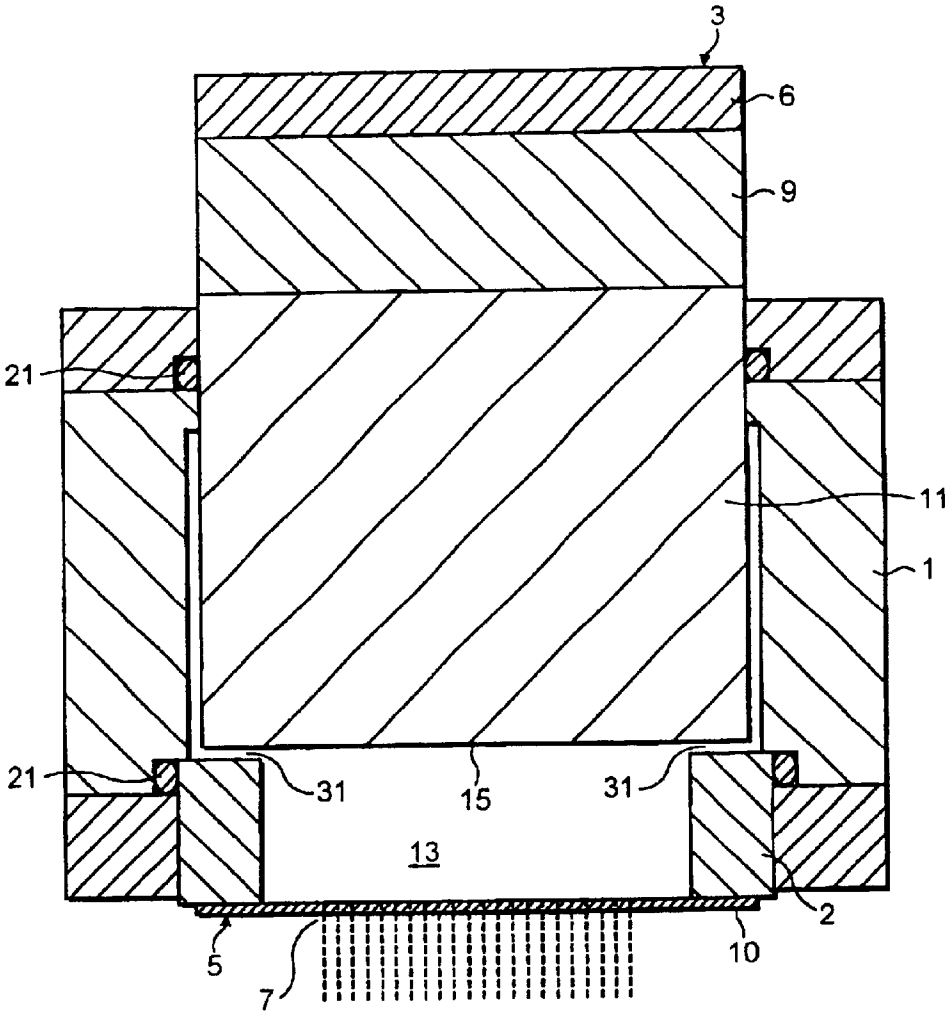
FIG. 2 is a side view of the generator.
Figure 1:
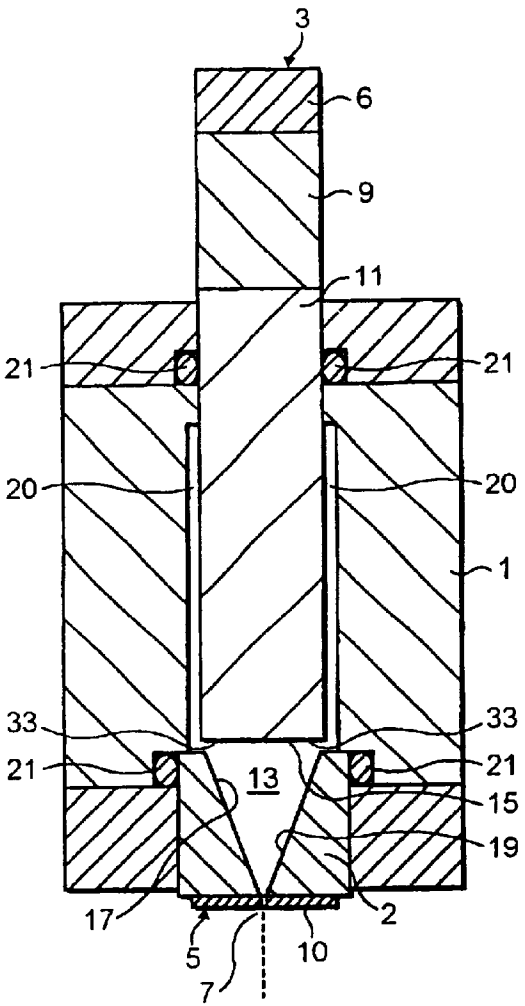
FIG. 1 is an end view of the generator.

Referring to FIGS. 1 and 2, the generator comprises a polyetheretherketone manifold 1, and, push fitted therein, an actuator 3 and a nozzle carrier 5. Actuator 3 comprises a piezoelectric driver 9, a stainless steel head 11 and a brass backing member 6. Nozzle carrier 5 comprises a stainless steel element 2 defining therein a 'V' cross section channel, and, bonded to element 2, a stainless steel foil sheet 10. Sheet 10 contains a line of nozzle orifices 7, and is so bonded to element 2 that this line runs along the length of the open apex of the 'V' cross section channel of element 2.

An elongate ink cavity 13 is defined by the lower face 15 of actuator 3 and interior faces 17, 19 of element 2 which define the 'V' cross section channel of element 2. Actuator 3 runs the length of cavity 13 and overlaps the ends and sides of cavity 13 at 31 and 33 respectively. A narrow gap 20 is present on either side of head 11 of actuator 3 between it and manifold 1. 'O' rings 21 seal against the further aggression of ink from cavity 13 and gaps 20. Thus, piezoelectric driver 9 is sealed from contact with the ink. Channels (not shown) are provided in manifold 1 and communicate with gaps 20 for the supply of ink to cavity 13 and the bleeding of air/ink from cavity 13.

At the frequency of operation of the generator, actuator 3 has a vertical thickness resonance at which all points across the lower face 15 of actuator 3 vibrate vertically in phase and with the same amplitude, i.e. at which lower face 15 is driven in contact with the ink in cavity 13 in piston-like manner.

Cavity 13 is shaped so as to provide a steady and essentially unidirectional flow of ink to nozzle orifices 7.

The reducing surface area in the direction of wave travel (i.e. from lower face 15 of actuator 3 to nozzle orifices 7) causes an increased acoustic pressure at the apex of the 'V' cross-section channel as compared to that at lower face 15.

Figure 3:
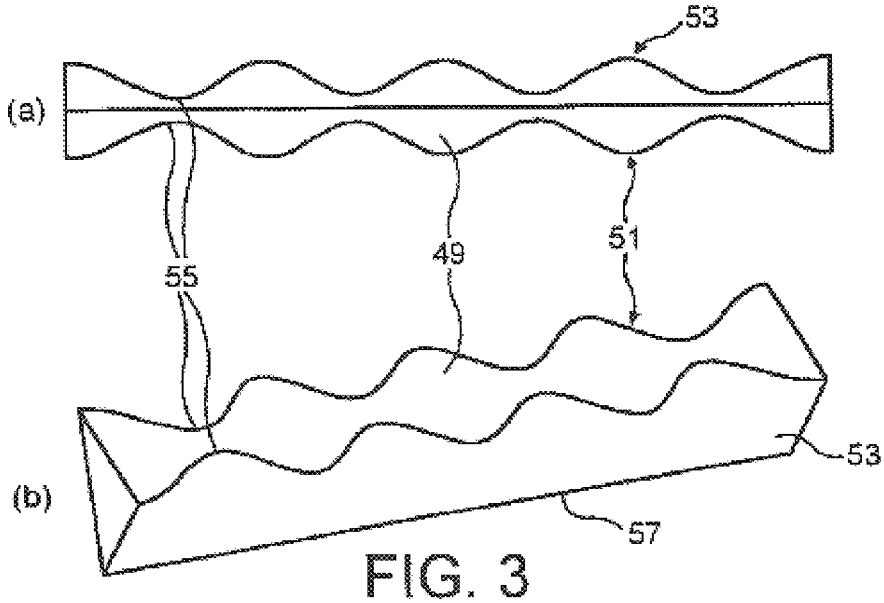
FIGS. 3*a*) and 3*b*) are plan and perspective views respectively of an elongate ink cavity of the generator, FIGS. 4*a*) and 4*b*) illustrate respectively the ink cavity's minimum and maximum cross-sectional area.
Figure 4:
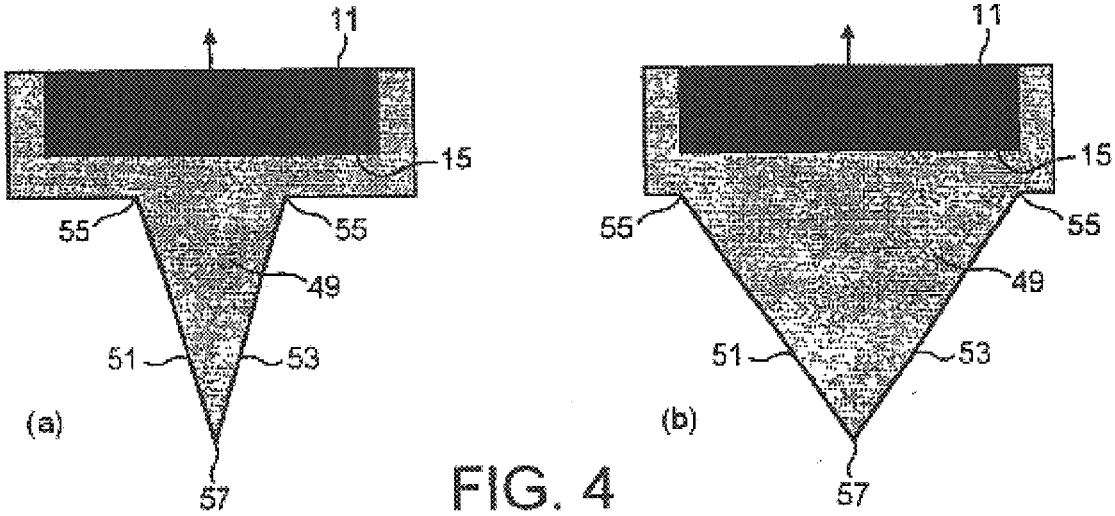

Referring now also to FIGS. 3 and 4, interior faces 17, 19 of element 2 undulate sinusoidally in synchronism hereby to produce a 'V' cross-section body of ink 49 in cavity 13 having correspondingly undulating sides 51, 53, as shown in FIGS. 3 and 4. The undulation is greatest at the tops 55 of the sides 51, 53 and gradually reduces in the direction of the apex 57 of the 'V' to peter to zero thereat. The effect of the undulation is that the cross-sectional area of the elongate body of ink 49 varies cyclically along its length between minimum (FIG. 4*a*)) and maximum (FIG. 4*b*)) values. The varying cross-sectional area of ink cavity 13 will be discussed further below.

At the frequency of operation of the generator of FIGS. 1 and 2, cavity 13 is non-resonant in the vertical direction, i.e. from lower face 15 of actuator 3 to line of nozzle orifices 7. This facilitates a relaxation in the required accuracy of the physical dimensions of the structural components of the generator. It also permits greater stray in operating parameters of the generator such as ink composition and temperature.

It is to be appreciated that if cavity 13 were to be designed to be resonant in the vertical direction, then it would be necessary at operating frequency for an integer number of half wavelengths to fit precisely in this vertical direction between lower face 15 of actuator 3 and line of nozzle orifices 7. A pure standing wave, extending in the vertical direction, would then be established. Thus, the acoustic pressure along line of nozzle orifices 7 would be the same, with the desirable result that the jets emanating from the orifices would break up into ink droplets at the same predetermined distance from the orifices. Such an arrangement, although advantageous in that uniform jet break up is conveniently achieved, is disadvantageous in that it is highly sensitive to inaccuracy in the structural dimensions and operating parameters of the generator.

Cavity 13 is also non-resonant along its length in operation of the generator. Thus, at operating frequency, an integer number of half wavelengths does not precisely fit into the length of cavity 13, and therefore a pure standing wave is not established which extends along cavity 13. Resonances along the length of cavity 13, so called resonance length modes, obviously occur at a series of frequencies. Thus, it is necessary that the generator be operated at a frequency that is between two successive length modes. It is to be understood that it would not be desirable to operate at a length mode frequency, since the acoustic pressure along line of nozzle orifices 7 would vary greatly. This variation would correspond to the nodes and antinodes of the established pure standing wave, and result in non-uniform jet break up. Clearly, operation is ideally midway between two successive length modes.

As aforesaid, cavity 13 is operated at a frequency between two length modes. A standing wave is established in cavity 13, but not a pure standing wave as mentioned previously. The standing wave established is a partial standing wave, and is the resultant wave generated by multiple reflections at the walls of cavity 13. There will be further below discussion of the operation of the ink cavity of FIGS. 3 and 4.

Figure 5:
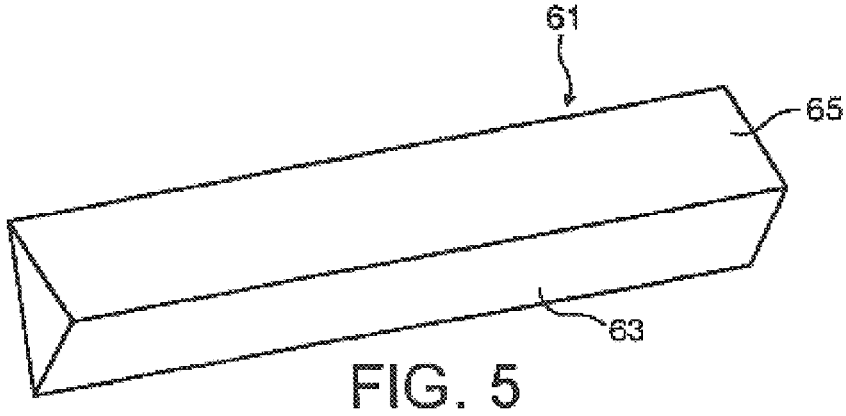
FIG. 5 is a perspective view of a known elongate ink cavity.
Figure 6:
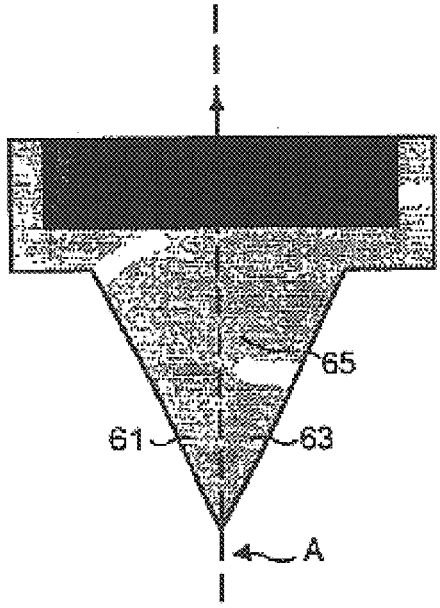
FIG. 6 is a cross-section of the known ink cavity.

Turning now to the known ink cavity of FIGS. 5 and 6, this ink cavity is the same as that shown in FIGS. 3 and 4 with the exception that its walls 61, 63 do not undulate but are flat and planar in form. Thus, the cross-sectional area of the known ink cavity does not vary but remains the same along its length. FIGS. 4*a*), 4*b*) and 6 are drawn to the same scale, thereby enabling comparison between the minimum and maximum cross-sectional areas of the body of ink 49 in cavity 13 and the cross-sectional area of the body of ink 65 in the known ink cavity.

Figure 7:
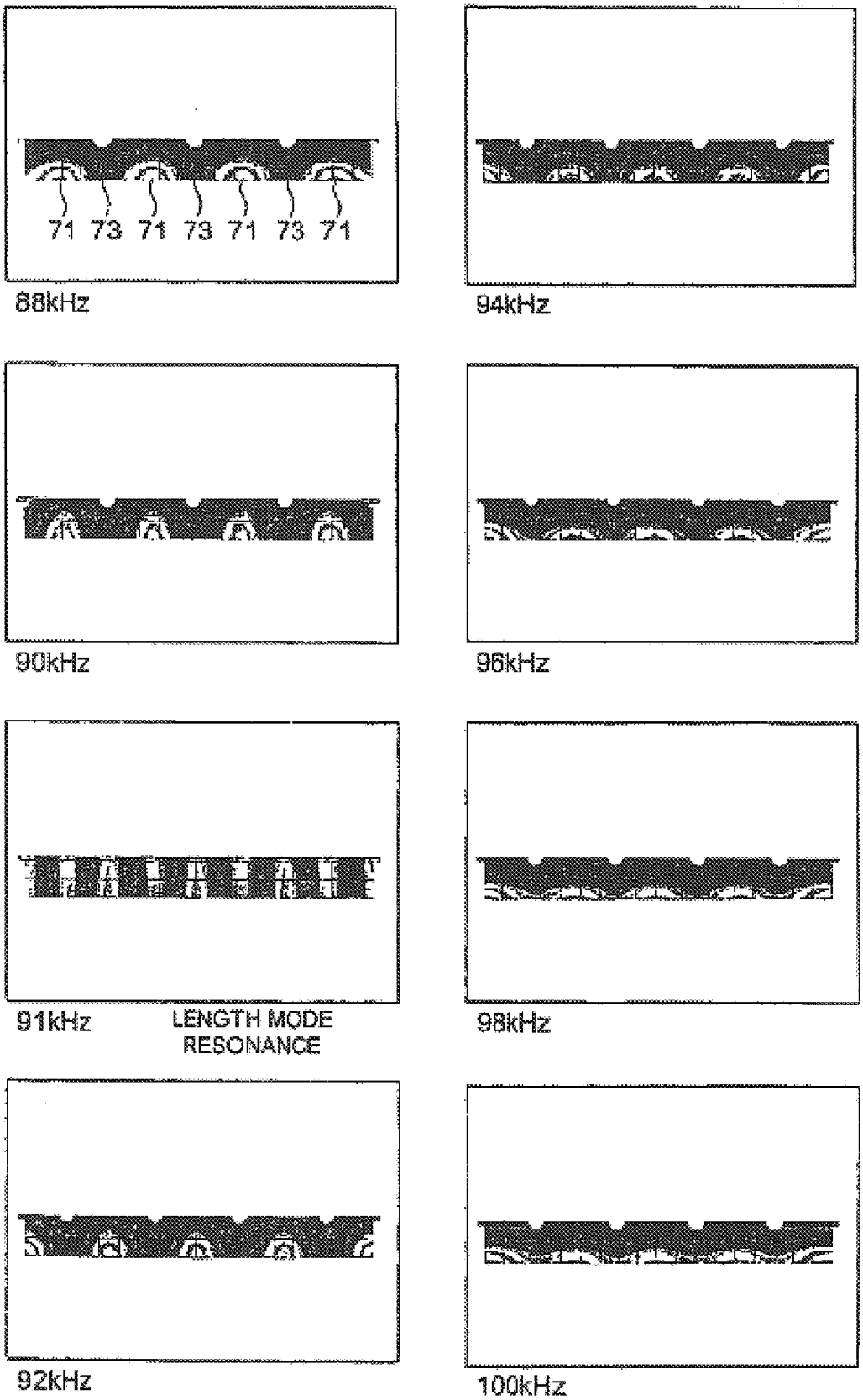
FIG. 7 illustrates, at each of a series of operating frequencies, contours of peak acoustic pressure within a plane extending along the known ink cavity.

Acoustic pressure variation within the known ink cavity will now be considered at each of a number of operating frequencies. In FIG. 7 each plot is of contours of peak acoustic pressure, at a given operating frequency, within plane A drawn in FIG. 6, which plane extends into the paper in FIG. 6. Considering the 88 kHz plot, the 'peaks' 71 along the line of nozzle orifices represent regions of high acoustic pressure, and the 'troughs' 73 between peaks 71 represent regions of low acoustic pressure. It can be seen that the acoustic pressure along the nozzle orifices varies greatly, resulting in non-uniform jet break up. This is also so in the case of the plots at all other seven frequencies. Thus, satisfactory operation, i.e. uniform jet break up, is not achieved with the known ink cavity at the operating frequencies of FIG. 7.

A length mode resonance occurs at 91 kHz. Thus, at 91 kHz a pure standing wave is established in the ink cavity. At the other seven frequencies a partial standing wave is established. An important feature to note is that both above and below 91 kHz, the regions of high and low acoustic pressure occur at the same spatial positions along the line of nozzle orifices. Thus, at 88 and 90 kHz the highs and lows occur at the same spatial positions. Similarly, at 92, 94, 96, 98 and 100 kHz the highs and lows occur at the same positions. Provided a length mode resonance frequency is not crossed, the spatial position of the highs and lows remains constant. In fact, in any given interval between two successive length modes, the spatial locations of the highs and lows are determined by the acoustic pattern of one of these two length modes, since it is this pattern that degenerates to provide the highs and lows between the two length modes. With reference to the 91 kHz plot and the higher frequency plots, the nine 'white stripe' highs of the 91 kHz plot degenerate in the higher frequency plots into five highs at the bottom of the ink cavity and four at the top.

Figure 8:
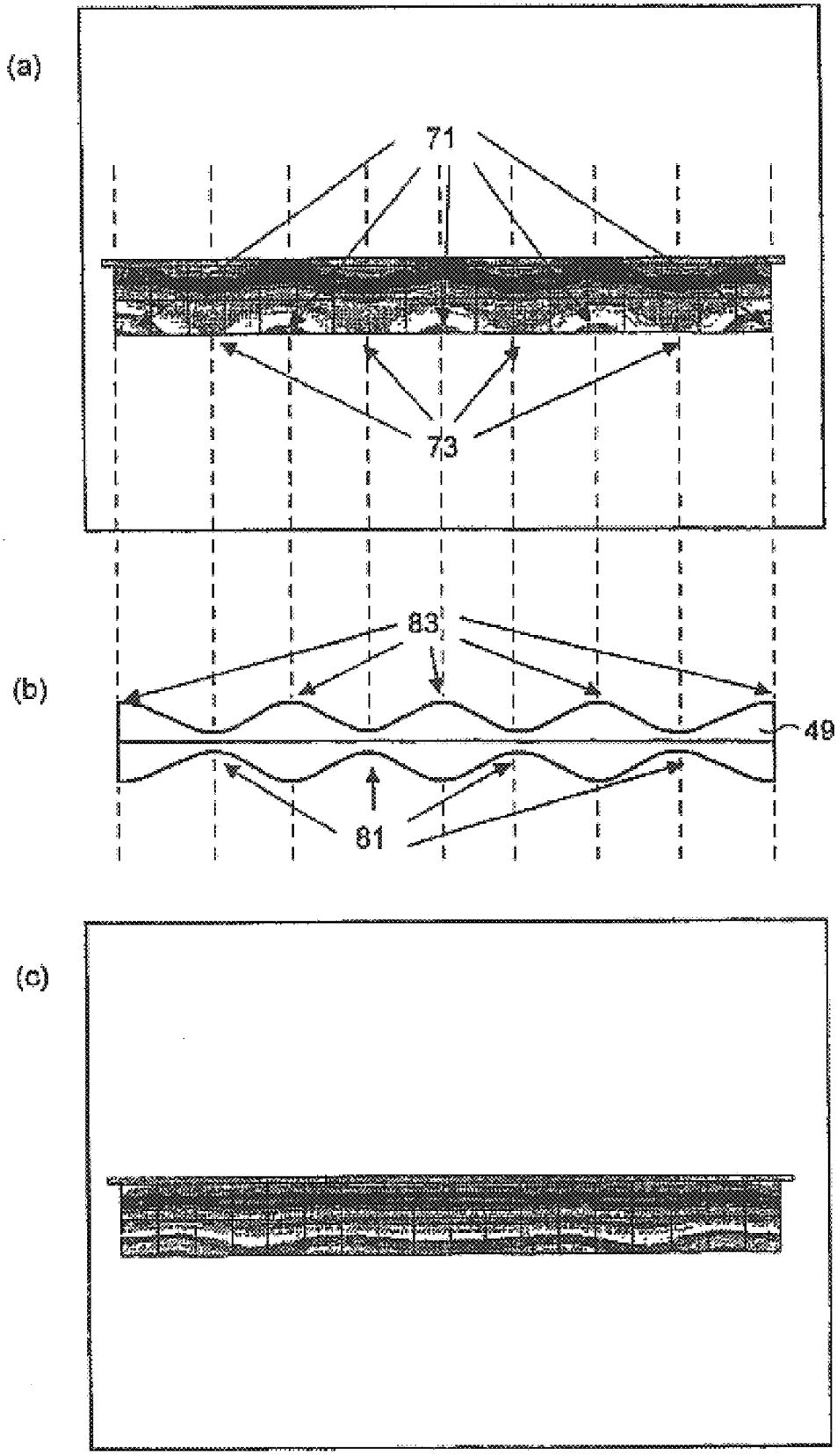
FIG. 8 compares ink cavity peak acoustic pressure when using the known ink cavity of FIGS. 5 and 6 to that when using the ink cavity of FIGS. 3 and 4.

FIGS. 8*a*) and 8*c*) are ink cavity peak acoustic pressure plots at generator operating frequency when using the known ink cavity of FIGS. 5 and 6 (FIG. 8*a*)) and the ink cavity according to the present invention of FIGS. 3 and 4 (FIG. 8*c*)). FIG. 8*b*)) is a repeat of FIG. 3*a*), and is drawn in line between FIGS. 8*a*) and 8*c*) to enable the relative positions of the acoustic pressure peaks and troughs of FIG. 8*a*) to be compared to the undulations of the walls of the body of ink in FIG. 8*b*). It can be seen that interior faces 17, 19 of element 2 of the generator are arranged to undulate so that body of ink 49 has a minimum cross-sectional area 81 whereat there is a region of low acoustic pressure 73, and a maximum cross-sectional area 83 whereat there is a region of high acoustic pressure 71. The effect of this is that the regions of high pressure are expanded to reduce the pressure thereat, and the regions of low pressure are constricted to increase the pressure thereat. The result is an evening-out of the acoustic pressure along the line of nozzle orifices as shown in FIG. 8*c*), resulting in the desired uniform jet break up.

Figure 9:
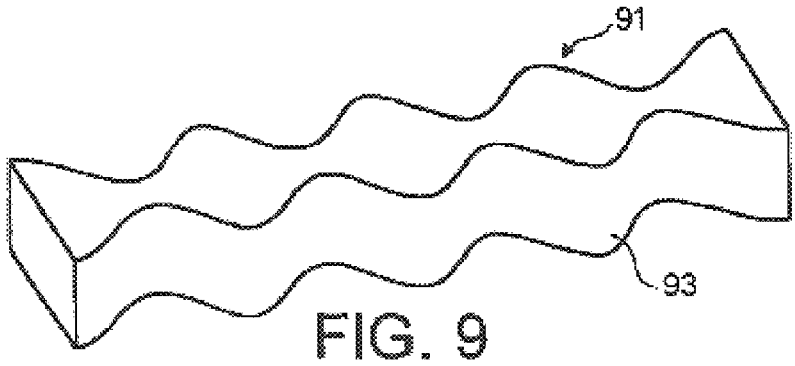
FIG. 9 is a perspective view of an alternative ink cavity according to the present invention.

The alternative ink cavity according to the present invention shown in FIG. 9 is the same as that shown in FIGS. 3 and 4 with the exception that the cavity has a rectangular cross-sectional area rather than triangular. The design principle is the same, i.e. the walls 91, 93 of the cavity undulate sinusoidally in synchronism so that the cavity has a minimum rectangular cross-sectional area whereat there is a region of low acoustic pressure at the nozzle orifices, and has a maximum rectangular cross-sectional area whereat there is a region of high acoustic pressure.

A further disadvantage with the acoustic pressure pattern shown in FIG. 8*a*) is that it is not possible to select a single drive voltage for piezoelectric driver 9 at which all jets meet the condition that they are satellite droplet free. The reason for this is that a given drive voltage does not 'appear' to have the same value at all nozzle orifices, because of the variation in acoustic pressure along the nozzle orifices. Thus, it is possible to select a drive voltage to meet the satellite free condition for say all the nozzle orifices in regions of low acoustic pressure, but adjustment of this voltage to meet the satellite free condition for the nozzle orifices in regions of high acoustic pressure takes the voltage outside the range that meets the satellite free condition for the low acoustic pressure nozzle orifices. The evening-out of acoustic pressure at the nozzle orifices shown in FIG. 8*c*) solves this problem.

The generator described by way of example is operated at a frequency between two successive length modes. As pointed out previously, between two such modes the regions of high and low acoustic pressure do not change their spatial locations. Thus, provided operation is kept between the two modes, satisfactory operation will be achieved. Indeed, operation is only limited by the room between the two length modes, which, with a typical ink and a 50 mm long cavity, would be about 10 kHz. This affords a very stable generator that is highly tolerant of both inaccuracy in the structural dimensions of the generator, and stray in its operating parameters.

In the generator described above by way of example, the drive signal applied to the piezoelectric driver is assumed sinusoidal, single frequency. This generates sinusoidal variations in the acoustic pressure distribution in the ink cavity, and necessitates that the compensating variation in the cross-sectional area of the cavity be sinusoidal in nature. The use of an alternative form of piezoelectric drive signal would therefore require a corresponding alternative form of shape profile for the cavity walls, the precise nature of this profile in any given case being determined so as to compensate for, i.e. even-out, variation in acoustic pressure along the line of nozzle orifices.

A further advantage of the present invention is that unwanted acoustic variations caused by other sources can also be compensated for or negated as long as they are of a constant form. For example, an actuator can be used not operating in a perfect vertical thickness resonance, i.e. having some amplitude and/or phase variation in the vibration. This can be accounted for in the cavity shaping. The foregoing allows the use of longer transducers that are difficult to make without some lateral variation in vibration amplitude and phase.

It is to be appreciated that the invention can be utilized in the context of a generator designed to operate with its cavity resonant in the vertical direction. If in such a generator the actuator is not operating in a perfect vertical thickness resonance as desired, the effect of this on the acoustic pressure distribution in the cavity can be compensated for by appropriate shaping of the cavity walls.

In the droplet generator described above by way of example, the invention is utilised in operation between two length modes. It is to be appreciated that even at a length mode frequency, appropriate variation in the cross-sectional area of the ink cavity along its length can be used to significantly 'flatten-out' acoustic pressure variation along the cavity.

In the above description there is present in a uniform cross-section ink cavity a standing wave the form of which is not as desired. This form is then tailored to improve it by varying the cross-sectional area of the cavity. In the description the tailoring is such as to achieve uniform jet break up. It can be imagined that the tailoring need not necessarily be such as to achieve uniform jet break up, but need simply be such as to achieve a desired jet break up profile along the line of nozzle orifices.

What is claimed is:

1. A droplet generator for a continuous stream ink jet print head, comprising:

a) an elongate cavity for containing ink;

b) nozzle orifices in a wall of the cavity for passing the ink from the cavity to form jets, said nozzle orifices extending along a length of the cavity;

c) actuator means disposed on an opposite side of the cavity to said wall for vibrating the ink in the cavity such that each said jet breaks up into ink droplets, a standing wave being present in the ink in the cavity during operation of the generator; and d) said cavity having a cross-sectional area which varies along said length in a manner so as to tailor a form of said standing wave in the cavity such that each said jet breaks up into the ink droplets at a respective predetermined distance from said wall of the cavity.

2. The generator according to claim 1, wherein the form of said standing wave is tailored such that each said jet breaks up into the ink droplets at substantially the same predetermined distance from said wall of the cavity.

3. The generator according to claim 2, wherein the cross-sectional area of the cavity varies cyclically along said length between minimum and maximum values, said cross-sectional area having the minimum value whereat said standing wave has a region of low acoustic pressure at the nozzle orifices, said cross-sectional area having the maximum value whereat said standing wave has a region of high acoustic pressure at the nozzle orifices.

4. The generator according to claim 3, wherein said cross-sectional area varies sinusoidally along said length.

5. The generator according to claim 2, wherein said cavity has a generally triangular cross-section.

6. The generator according to claim 2, wherein said cavity has a generally rectangular cross-section.

7. A method of operating a droplet generator for a continuous stream ink jet print head, comprising the steps of:

a) containing ink in an elongate cavity having a length and a cross-sectional area;

b) passing the ink from the cavity through nozzle orifices in a wall of the cavity to form jets, the orifices extending along the length of the cavity;

c) vibrating the ink in the cavity such that each said jet breaks up into ink droplets, a standing wave being present in the ink in the cavity during operation of the generator;

d) varying the cross-sectional area of the cavity along said length to tailor a form of the standing wave in the cavity such that each said jet breaks up into the ink droplets at a respective predetermined distance from said wall of the cavity; and e) permitting parameters of the operation of the generator to stray such that the cavity operates over a range extending substantially all the way between two successive resonances along the length of the cavity.

8. The method according to claim 7, wherein said parameters of the operation permitted to stray are ink composition and temperatures.

9. The method according to claim 7, wherein said cavity operates at substantially midway between the two successive resonances along the length of the cavity.

* * * * *